US008647473B2

(12) United States Patent
Olsson

(10) Patent No.: US 8,647,473 B2
(45) Date of Patent: Feb. 11, 2014

(54) CONTINUOUS DIGESTER WITH A BOTTOM SCRAPER EQUIPPED WITH DRAINING APERTURES

(75) Inventor: Krister Olsson, Karlstad (SE)

(73) Assignee: Metso Paper Sweden AB, Sundsvall (SE)

( * ) Notice: Subject to any disclaimer, the term of this patent is extended or adjusted under 35 U.S.C. 154(b) by 0 days.

(21) Appl. No.: 13/979,851

(22) PCT Filed: Jan. 25, 2011

(86) PCT No.: PCT/SE2011/050075

§ 371 (c)(1), (2), (4) Date: Aug. 22, 2013

(87) PCT Pub. No.: WO2012/102650

PCT Pub. Date: Aug. 2, 2012

(65) Prior Publication Data

US 2013/0319628 A1 Dec. 5, 2013

(51) Int. Cl.
*D21C 7/00* (2006.01)

(52) U.S. Cl.
USPC ..... 162/237

(58) Field of Classification Search
USPC ..... 162/232, 237, 246, 236
IPC ..... D21C 7/00,3/228, 9/10
See application file for complete search history.

(56) References Cited

U.S. PATENT DOCUMENTS

| | | | | |
|---|---|---|---|---|
| 3,475,271 | A | 10/1969 | Laakso | |
| 5,736,005 | A * | 4/1998 | Flodquist | 162/52 |
| 2003/0111200 | A1 | 6/2003 | Prough | |

FOREIGN PATENT DOCUMENTS

| | | |
|---|---|---|
| GB | 322741 | 12/1929 |
| WO | WO2005116327 | 12/2005 |
| WO | WO2005116328 | 12/2005 |

* cited by examiner

*Primary Examiner* — Mark Halpern
(74) *Attorney, Agent, or Firm* — Rolf Fasth; Fasth Law Offices

(57) ABSTRACT

The continuous digester is for producing pulp from comminuted cellulosic material. The digester has a cone diverter on a bottom scraper arranged in the bottom of the digester for assisting in out feed of pulp produced. The cone diverter of the bottom scraper has an upper inclined surface of the cone diverter with an inclination angle in the range 30±10 degrees in relation to the vertical. In order to improve washing performance in the bottom of the digester, especially for overloaded digesters, the upper inclined surface is equipped with draining apertures in fluid communication with a liquid receiving chamber inside the cone diverter. The liquid receiving chamber is connected via a drainage channel to the exterior of the vessel.

10 Claims, 5 Drawing Sheets

CONTINUOUS DIGESTER WITH A BOTTOM SCRAPER EQUIPPED WITH DRAINING APERTURES

PRIOR APPLICATION

This application is a U.S. national phase application that is based on and claims priority from International Application No. PCT/SE2011/050075, filed 25 Jan. 2011.

TECHNICAL FIELD

The present invention concerns a continuous digester that has a bottom scraper equipped with draining apparatus.

BACKGROUND AND SUMMARY OF THE INVENTION

In Prior Art for cooking of chemical cellulose pulp with continuous digesters it has been a well known practice to use a vertical digester vessel, with an established down-flow process developed in the vessel from the upper inlet end and down to the lower outlet end.

During the first 3 decades of implementation of such continuous digesters was a long countercurrent washing zone established in bottom of the digester, most often over some 40-50% of the total height of the digester. This type of cooking process is often recited as "conventional cooking".

However, as higher production capacity came into demand this wash zone was reduced to only the final 5-10% of the total pulp retention time of the digester, while using more of the retention time in the digester for the actual cooking or delignification process. "Modified continuous cooking" was thus launched; having many variants such as ITC-cooking (Iso Thermal Cooking), EAPC-cooking (Enhanced Alkali Profile Cooking) etc.

Many of the old digesters, having been designed for "conventional cooking" or "Modified continuous cooking" also tried to increase production capacity, and this resulted in that the digester most often became overloaded, and the originally intended wash zone lost some of its function as a wash effect. Then some of the washing had to be done in subsequent wash equipment.

Attempts have been made to design and improve the bottom wash of the digester. As early as 1969 was U.S. Pat. No. 3,475,271 issued, where the wash zone was more or less inverted in relation to common wash zones. Common wash zones had extraction screens in the wall of the digester, while adding wash liquid to bottom via nozzle below the extraction screens or even integrated with the bottom scraper. In U.S. Pat. No. 3,475,271 the system was inverted, such that wash liquid was added via "distribution screens" in the wall of the digester, and having a tubular extraction screen co-rotating with the bottom scraper. However, this system was no success as it included a complicated and expensive tubular body as long as the digester itself and co-rotating with the bottom scraper. The tubular body also had to have a diameter in the range of ⅕ to ⅓ of the diameter of the digester vessel, which meant that a large volume of the digester was not used for the important cooking process, all in order for establishment of sufficient extraction screen area for being able to withdraw the volumes of spent liquor.

Similar tubular central screen body was also used in some smaller pin chip digesters installed in the early 70-ies. In a typical installation in a pin chip digester with total height of about 22 meter was the height of the tubular screen body about 7.5 meter, i.e. roughly ⅓ of the total digester height.

The diameter of the screen body was about 1.5 meter in the vessel having a diameter of about 3.7 meter. This meant that a large volume of the total digester volume was not available for the cooking process and hence a low production capacity per volume unit of the digester.

The concept with central screen bodies was also shown in WO2005/116327 and WO2005/116328, but in these embodiments was the central screen body integrated with the stationary central pipe. As the screen body was implemented in the central pipe, having a relatively small diameter, a limited withdrawal capacity could be obtained.

The above mentioned disadvantages with central tubular screen bodies included spacious screen bodies reducing the total volume of the digester, and had only a reduced rubbing action from the descending chip column on the screen surface for maintaining this screen surface free from blocking objects (i.e. chips in differing state of delignification)

The principle object of the invention is to obtain an improved withdrawal capacity in the bottom of the digester, while still not being spacious and reducing the available volume in the digester used for the cooking process.

A specific objective is to enable an improved wash zone in the bottom of the digester and especially for those digesters that are operating in an overloaded state such that the original wash effect in the bottom of the digester has disappeared. Thus suitable for an up-grade in those overloaded digesters.

Yet another specific objective is to be able to maintain a high withdrawal capacity in a relatively small screen area, by increasing the rubbing action from the descending pulp column keeping the draining apertures of the screen clean, which is made possible by exposing the screen area for an increased vertical downward thrust from the descending pulp column.

The invention can advantageously be used when cooking hard wood and softwood chips, bagasse and other annual plants.

The characteristics of the invention are defined by the independent claims, and optional embodiments are defined in dependent claims in order of dependency of preceding claims. The invention is also disclosed in a preferred embodiment, but any specific feature of this embodiment could as such be included in the invention optionally, if not specifically defined as a necessary feature for the argued effect.

DETAILED DESCRIPTION OF PREFERRED EMBODIMENTS

Figure 1:
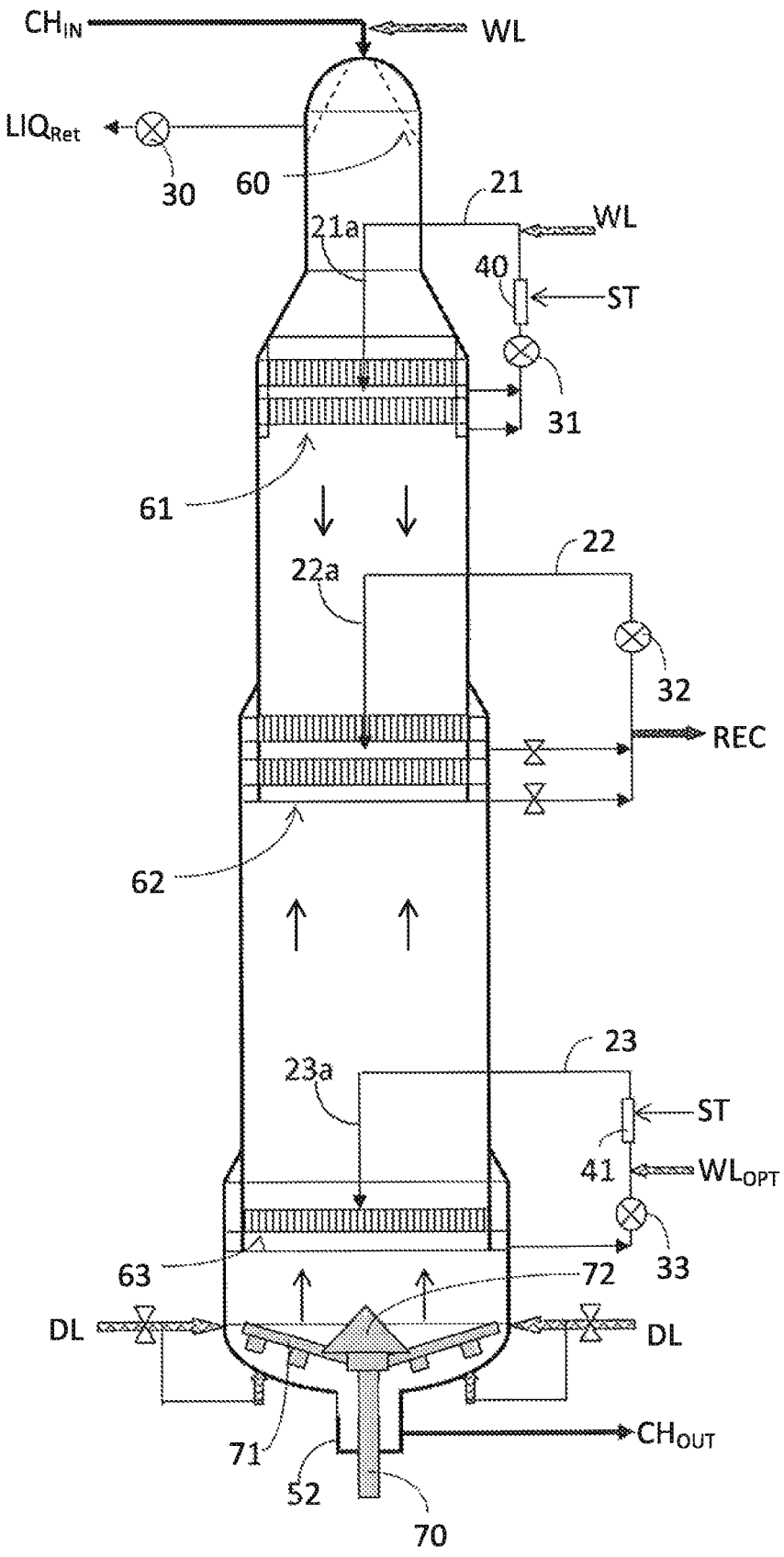
Fig. 1 Prior art
FIG. 1 shows a continuous digester in its basic features according to prior art.

FIG. 1 shows a typical design of a conventional continuous digester. The cellulose material $CH_{IN}$ is fed to the top of the digester vessel with additional charge of cooking chemicals WL. Excess liquor $LIQ_{RET}$ is withdrawn in a top separator via a first strainer section 60 and a pump 30.

In a first cooking circulation comprising a strainer section 61, pump 31, heating device 40 and a central pipe 21*a* is the cellulose material heated to the necessary cooking temperature and cooking chemicals WL is added.

The cellulose material is thereafter moving down in a plug flow concurrent with the flow of cooking chemicals trough the digesting zone until it reaches an extraction circulation which terminates the cooking zone. The extraction circulation comprises a strainer section 62, here with 2 screen rows, pump 32, and a central pipe 22*a*. A larger part of the withdrawn and used treatment liquor is extracted from the digester and sent to recovery REC, or alternatively sent to any black liquor impregnation vessel preceding the cooking vessel.

Below the strainer section 62 of the extraction circulation is a counter current hi-heat washing zone established, and the cellulose material is moving down in a plug flow trough the washing zone until it reaches a wash circulation which terminates the hi-heat washing zone. The wash circulation comprises a strainer section 63, here with 1 screen row, pump 33, and a central pipe 23*a*. As indicated is this wash circulation complemented with a heating device 41.

As indicated in this drawing could also the wash circulation be complemented with an addition of cooking chemicals $WL_{OPT}$, which then modifies the washing zone to a cooking zone.

Finally, cold wash and dilution liquid DL is added to the bottom of the digester via a number of vertical and horizontal nozzles, which results in a counter current wash displacement zone towards the wash circulation, in order to remove cooking chemicals and dissolved organic material, as well as lowering of the temperature of the pulp before out feed from the digester, and dilution of the pulp in order to facilitate out feed of digested cellulose material $CH_{OUT}$.

In the bottom of the digester is in a conventional manner a bottom scraper arranged, comprising a drive shaft 70, scraper arms 71 and a cone diverter 72. The purpose of the cone diverter 72 is to force the central volume of the chip column towards the scraper arms, avoiding the risk for channelling inside the digester. Unless said cone diverter it may cause a non-uniform chip column movement as a more rapid flow in the centre of the digester may be developed towards the central outlet bucket 52 compared with chip column movement close to the digester walls.

While FIG. 1 only discloses the basic features of conventional continuous digester, it is to be understood that the system could be modified in a number of ways. For example, the number of circulations could be more than those shown in FIG. 1. The heating devices 40, 41 could either be heaters using direct heating with steam, i.e. mixing steam into the circulation, or heat exchangers.

Figure 2:
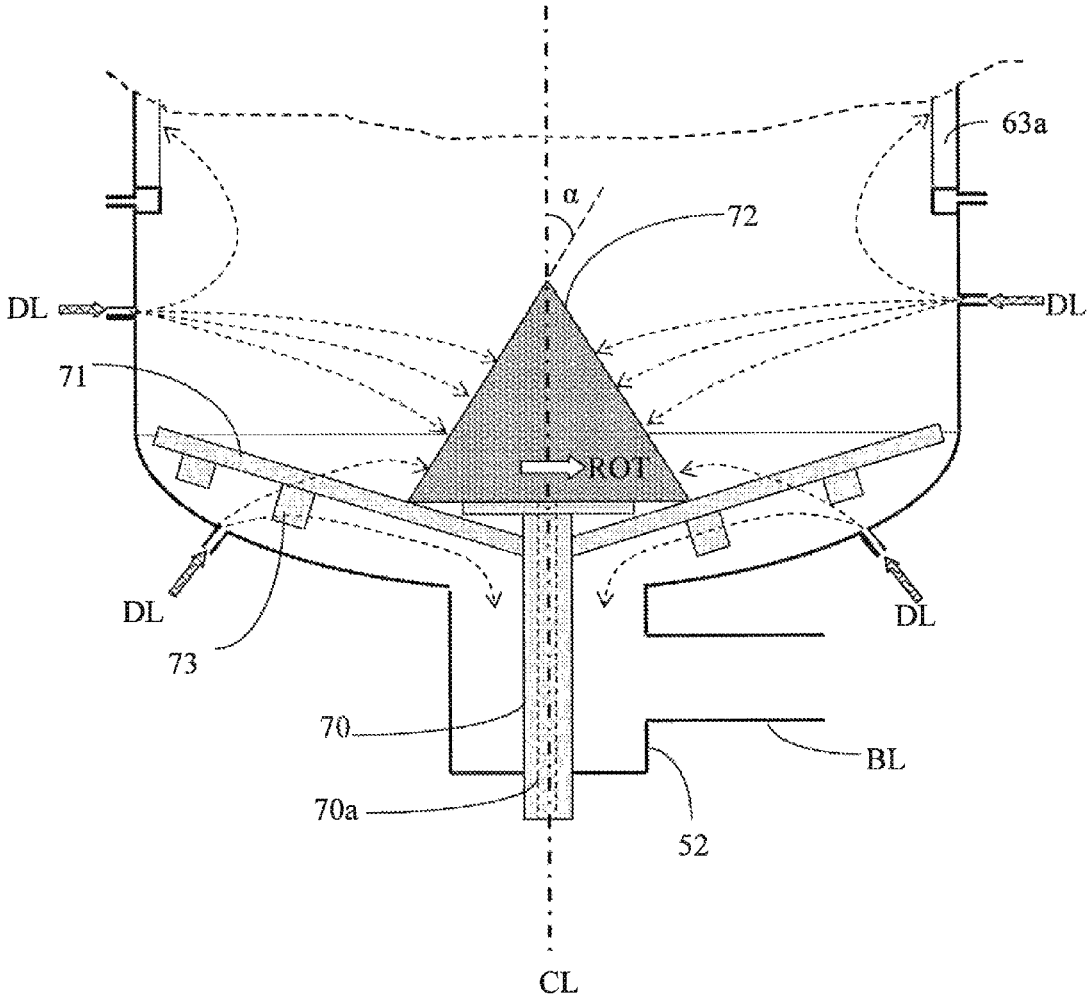
FIG. 2 shows a first embodiment of the cone diverter using circular drainage apertures.

In FIG. 2 is a detail view of the bottom scraper shown in FIG. 1, but here modified according the inventive concept. The bottom scraper comprises the drive shaft 70, the scraper arms 71 and a cone diverter 72, all co-rotating as one common unit. The pulp descending down the vessel in a plug flow is broken up by the bottom scraper and paddles 73 push the pulp towards the outlet bucket 52 before being fed out via the blow line BL. During this process is dilution/wash liquid DL added via horizontal and vertical nozzles. The upper inclined surface of the cone diverter 72 has an inclination angle ($\alpha$) in the range 30±10 degrees in relation to the vertical, here indicated as the centre line CL. According to the invention is the upper inclined surface equipped with draining apertures in fluid communication with a liquid receiving chamber CC inside the cone diverter, said liquid receiving chamber connected to a drainage channel 70*a* to the exterior of said vessel. In this first embodiment are the draining apertures 80 drilled circular holes having the edges of the drainage apertures all aligned with the inclined surface of the cone diverter. The opening of the drainage apertures 80 have a smallest diameter less than 5 millimeter, but equal or larger than 1 millimeter, and the appropriate size is dependent on the type of wood material being fed to the digester. If ordinary sized chips are fed to the digester could larger holes be used in the recommended range 1-5 millimeter, preferably in the range 2-4 millimeter, than if saw dust or similar small fractions are fed to the digester. The total effective open area of the apertures in the cone diverter is typically in the range 10-30%, and preferably at least 15%.

In the bottom of the digester are typically narrower slots or bore holes used in any draining structures as the wood material is delignified to a great extent and thus more vulnerable for withdrawal compared to locating draining structures in the top of the digester.

As indicated in FIG. 2 is a displacement wash effect developed from the dilution/wash liquid nozzles and towards the drainage apertures in the upper inclined surface of the cone diverter 72 (indicated by broken arrows). This means that the added dilution/wash liquid DL will displace the liquid towards the apertures, and ideally should the displacement front end at the surface of the cone diverter such that the old liquid in the pulp is withdrawn and replaced with new fresh dilution/wash liquid DL. As indicated is also a part of the added liquid DL also flowing directly towards the outlet bucket 52 as well as towards the lowermost strainer section 63*a*.

Figure 3:
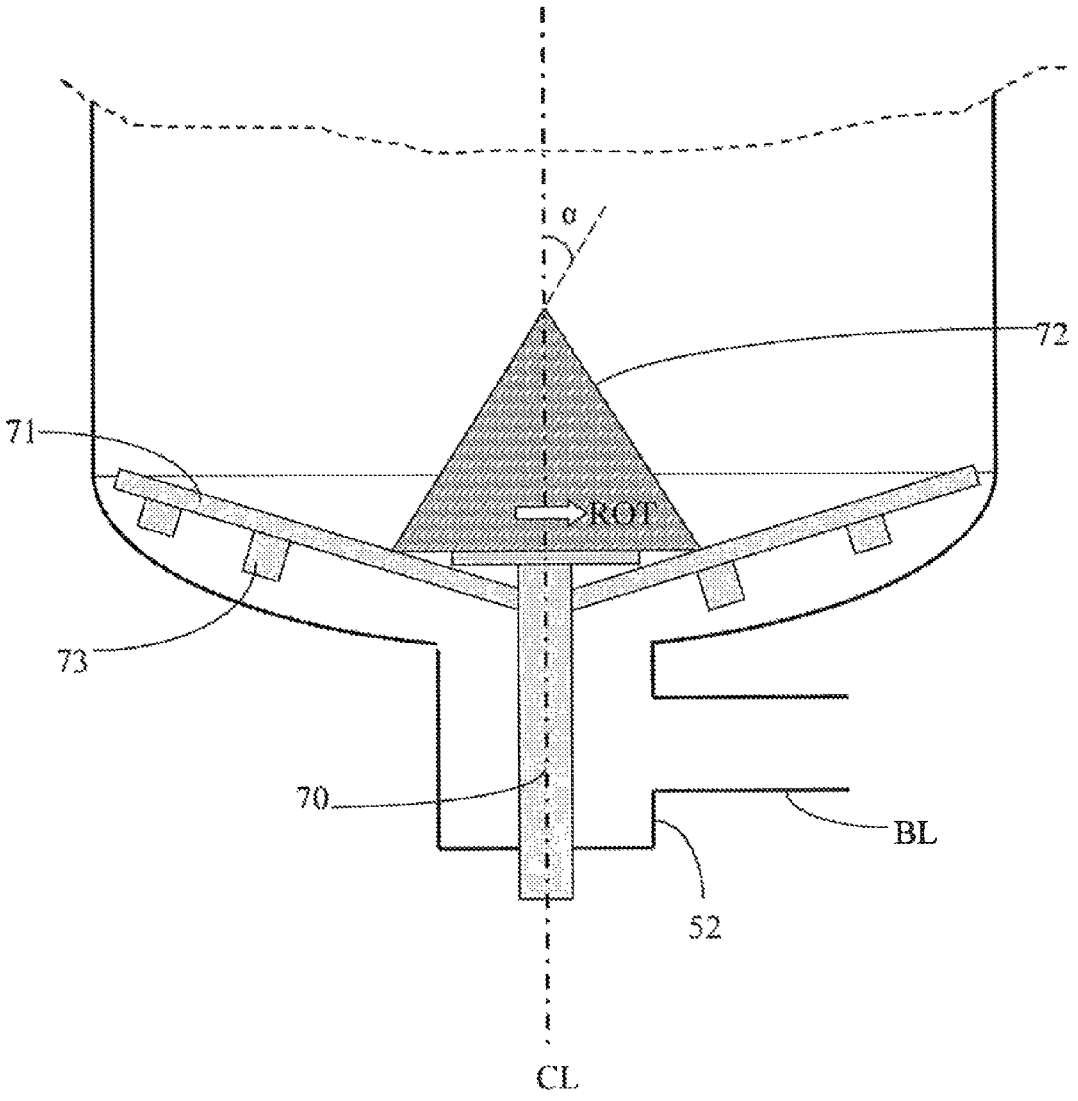
FIG. 3 shows a second embodiment of the cone diverter using elongated slot-like drainage apertures.

In FIG. 3 is a detail view of the bottom scraper shown in FIG. 1, but here modified according the inventive concept but with drainage apertures in the cone diverter having an elongated slot like form. As indicated are rows of slots arranged over the the upper inclined surface of the cone diverter 72. Also in this embodiment are the drainage apertures having a smallest width across the slot less than 5 millimeter, and preferably equal or larger than 1 millimeter. The length of the slots could vary in the range from 50 to 200 millimeters or even longer.

Figure 4:
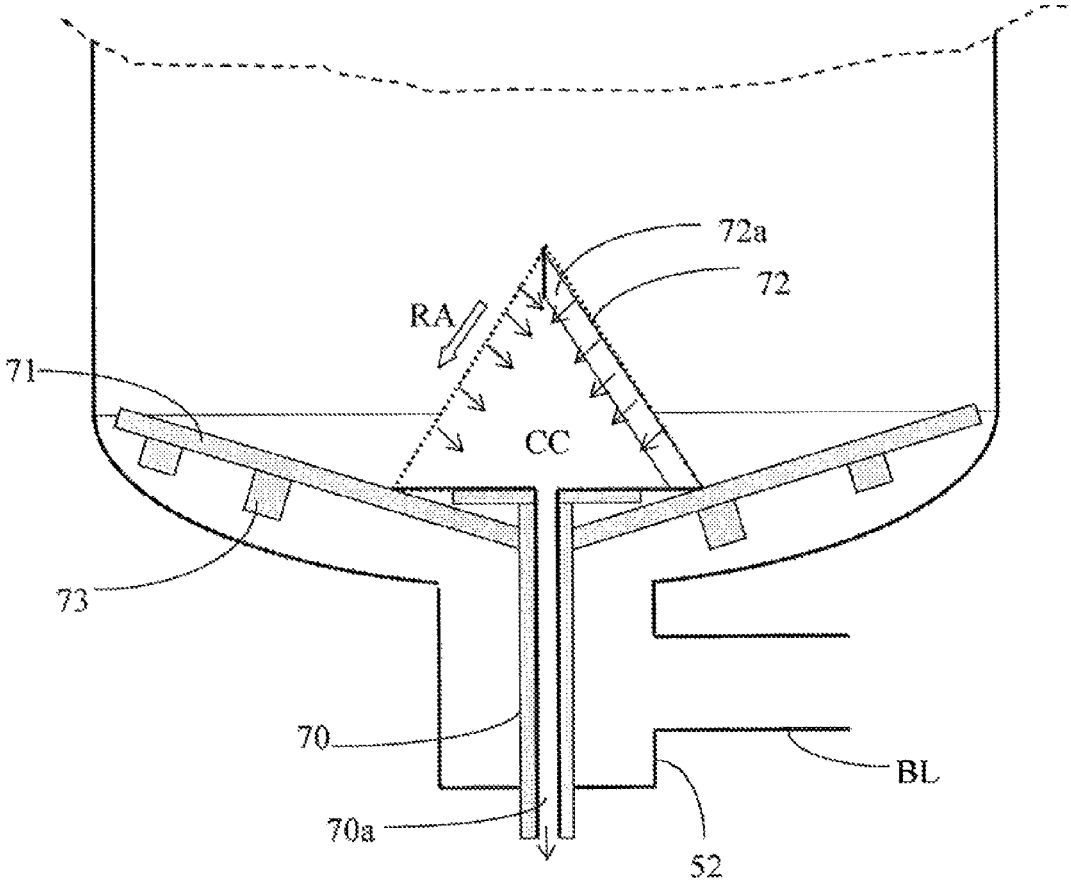
FIG. 4 shows the principle drainage structure of the cone diverter.

In FIG. 4 is the general drainage structure shown, which is similar to both embodiments shown in FIGS. 2 and 3. Here the cone diverter 72 is seen in a vertical section view. When the drained liquid has passed the apertures of the upper inclined surface of the cone diverter, indicated with multiple arrows, all the drained liquid will be collected in a receiving chamber CC inside the cone diverter. The liquid receiving chamber CC is then connected at its bottom to a drainage channel 70*a* to the exterior of said vessel. In this embodiment is the drainage channel 70*a* located inside of the vertical drive shaft 70 of the bottom scraper, i.e. as a concentric bore trough said drive shaft. As indicated on the right hand side of the receiving chamber CC could the upper inclined surface of the cone diverter be supported by vertically oriented reinforcing ribs 72*a*, here only one shown, but in a number sufficient to withstand the axial downward thrust from the pulp column. Alternatively could also horizontally oriented reinforcing rings be used between the ribs and the inclined surface of the cone diverter. As indicated with arrow RA is a rubbing action exposed to the inclined surface of the cone diverter and the apertures therein, and as the cone angel $\alpha$ is in the range 45±15 degrees in relation to the vertical is the downward thrust increasing proportionally to the increase of this cone angle. However a cone angel $\alpha$ of about 45 degrees is the optimum trade-off for obtaining a high rubbing effect as well as a smooth redirection of the central pulp volume towards the scraper arms avoiding channeling.

Figure 5A:
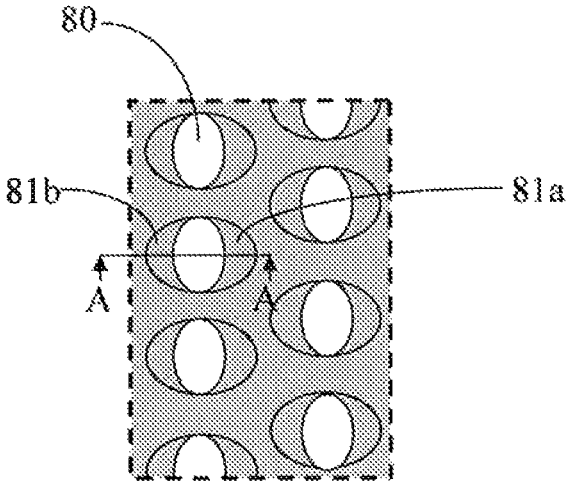
FIG. 5*a* shows a detail view of an embodiment with circular drainage apertures as seen from the pulp side.
Figure 5B:
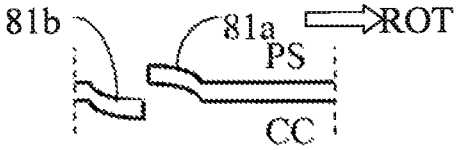
FIG. 5*b* shows a side view seen from section A-A in FIG. 5*a*.

In FIG. 5*a* is shown a detail view of an embodiment with circular drainage apertures 80 as seen from the pulp side. In FIG. 5*b* is this embodiment seen in section A-A in FIG. 5*a*, with the pulp side marked as PS and the liquid receiving chamber side marked as CC. The direction of rotation of the cone diverter surface is indicated by arrow ROT, and the trailing edges 81*b* of the drainage apertures on the upper inclined surface of the cone diverter are recessed in relation to the inclined surface of the cone diverter in a direction towards the liquid receiving chamber CC.

The leading edges 81*a* of the drainage apertures 80 on the upper inclined surface of the cone diverter 72 are at least aligned with the inclined surface of the cone diverter, but in this embodiment they are also elevated in relation to the inclined surface of the cone diverter in a direction away from the dilution/wash liquid DL In this context the leading edge is the edge that is initially exposing the drainage aperture 80 for a new pulp volume as the cone diverter is rotating and the trailing edge is the edge that is closing the drainage aperture 80 for the pulp volume having being exposed to drainage by said drainage aperture. The design reassembles a cheese grater, but with no cutting edges directed towards the pulp volume inside the digester as the cone diverter rotates.

Figure 6:
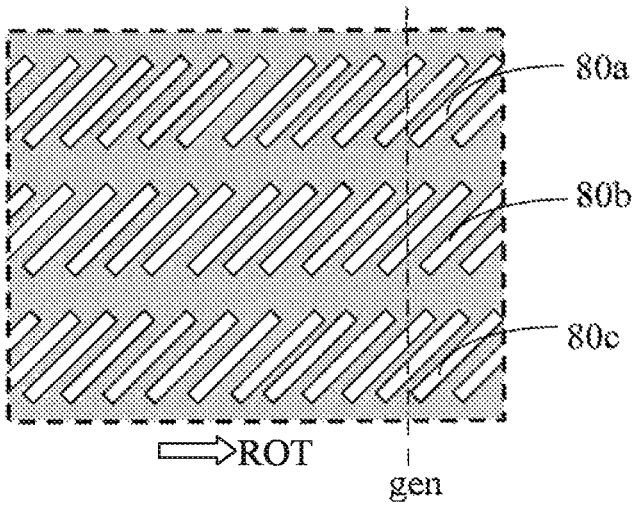
FIG. 6 shows a detail view of an embodiment with elongated slot-like drainage apertures as seen from the pulp side.

In FIG. 6 is shown a detail view of an embodiment with elongated slot-like drainage apertures 80*a*, 80*b*, 80*c* as seen from the pulp side. Here are the slots arranged in rows, with an upper row with slots 80*a*, an intermediate row with slots 80*b* and a lower row with slots 80*c*. The number of rows are used is dependent on the height of the cone diverter, i.e. size and capacity of the digester, as well as the length of extension of each slot. Preferably could also the slots have a width that is slightly increasing towards the liquid receiving chamber CC, i.e. if the slot width at the pulp side is 4 millimeter then the slot width at the side towards the liquid receiving chamber CC could be some 0.1 to 0.5 millimeter wider. This in order to let pass any obstacle trough the apertures if initially trapped in the slots and thus avoiding permanent blockage.

As to the lower end of each slot it could preferably have an inclined end surface, such that this end surface is closer to the strict horizontal location, i.e. the end surface at an angle (90°-α), or even with less inclination angle (α being the cone diverter angle as indicated in FIG. 2). This in order to establish a sloping surface such that obstacles caught against the slots in their upper slot part, and rubbed against the entire slot length, may be pushed out from the lower end of the slot.

The invention could be altered in many ways under the inventive scope as defined in claims. Whether or not circular holes or slots should be used is a matter of convenience for production and keeping manufacturing costs low. Slots could preferably be made using water or laser cutting techniques.

The invention could also be combined with a dilution scraper, i.e. a scraper adding dilution liquid also via its arms. In such embodiment could preferably dilution liquid be added as well via the drive shaft of the bottom scraper, but in a separate supply channel, preferably in form of a coaxial outer channel. Such a supply of dilution liquid to the arms of the bottom scraper could also be used to back flush the apertures via any appropriate controllable valve means.

While the present invention has been described in accordance with preferred compositions and embodiments, it is to be understood that certain substitutions and alterations may be made thereto without departing from the spirit and scope of the following claims.

The invention claimed is:

1. A continuous digester for producing pulp from comminuted cellulosic material, comprising, a vertically extending cylindrical digester vessel, a feeder disposed at an upper end of the vessel, a pulp discharge having an outlet defined therein at a lower end of the vessel, addition means for adding liquid (DL) in a lowermost part of a vessel wall, the vessel having a rotatable bottom scraper arranged at a center and bottom of the vessel, the scraper being in operative engagement with a vertical drive shaft for assisting in out-feed of pulp from the vessel, the bottom scraper having a cone diverter fixedly arranged to and co-rotatable with the bottom scraper, the cone diverted being located above the bottom scraper, the outlet being co-axially arranged about the vertical drive shaft, an upper inclined surface of the cone diverter having an inclination angle (α) in a range of 30±10 degrees relative to a vertical axis (CL), the upper inclined surface having draining apertures defined therein in fluid communication with a liquid receiving chamber (CC) disposed inside the cone diverter, and the liquid-receiving chamber being connected to a drainage channel, the liquid-receiving chamber extending to an exterior of the vessel.

2. The continuous digester according to claim 1 wherein the drainage channel is located inside the vertical drive shaft of the bottom scraper.

3. The continuous digester according to claim 2 wherein edges of the drainage apertures on the upper inclined surface of the cone diverter are aligned with the inclined surface of the cone diverter.

4. The continuous digester according to claim 2 wherein leading edges of the drainage apertures on the upper inclined surface of the cone diverter are at least aligned with the inclined surface of the cone diverter, and trailing edges of the drainage apertures on the upper inclined surface of the cone diverter are recessed in relation to the inclined surface of the cone diverter.

5. The continuous digester according to claim 4 wherein the leading edges are elevated in relation to the inclined surface of the cone diverter in a direction away from the liquid receiving chamber (CC).

6. The continuous digester according to claim 1 wherein the drainage apertures are circular.

7. The continuous digester according to claim 6 wherein the drainage apertures have a smallest diameter less than 5 millimeter.

8. The continuous digester according to claim 1 wherein the drainage apertures have an elongated slot-like shape.

9. The continuous digester according to claim 8 wherein the drainage apertures have a smallest width across the drainage apertures being less than 5 millimeters.

10. The continuous digester according to claim 8 wherein drainage apertures are arranged in rows.

* * * * *